US010347192B2

(12) United States Patent
Zou et al.

(10) Patent No.: US 10,347,192 B2
(45) Date of Patent: Jul. 9, 2019

(54) LIQUID CRYSTAL DISPLAY APPARATUS AND BACKLIGHT CONTROL METHOD THEREOF

(71) Applicant: WUHAN CHINA STAR OPTOELECTRONICS TECHNOLOGY CO., LTD., Wuhan, Hubei (CN)

(72) Inventors: Gonghua Zou, Wuhan (CN); Qingcheng Zuo, Wuhan (CN)

(73) Assignee: Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 342 days.

(21) Appl. No.: 15/100,120

(22) PCT Filed: Apr. 1, 2016

(86) PCT No.: PCT/CN2016/078255
§ 371 (c)(1),
(2) Date: May 27, 2016

(87) PCT Pub. No.: WO2017/156800
PCT Pub. Date: Sep. 21, 2017

(65) Prior Publication Data

US 2018/0090077 A1 Mar. 29, 2018

(30) Foreign Application Priority Data

Mar. 15, 2016 (CN) ..... 2016 1 0146214

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2320/064* (2013.01);
(Continued)

(58) Field of Classification Search
CPC ..... G09G 3/3406; G09G 3/36; G09G 2320/0646; G09G 2320/08; G09G 2320/064; G09G 2360/16
See application file for complete search history.

(56) References Cited

U.S. PATENT DOCUMENTS 7,352,352 B2 4/2008 Oh et al.
8,576,157 B2 11/2013 Bae
(Continued)

FOREIGN PATENT DOCUMENTS

CN 101325035 A 12/2008
CN 101393723 3/2009
(Continued)

OTHER PUBLICATIONS

International Search Report for PCT/CN2016/078255, Completed by the Chinese Patent Office on Jun. 10, 2016, 14 Pages.

*Primary Examiner* — Abhishek Sarma
(74) *Attorney, Agent, or Firm* — Mintz Levin Cohn Ferris Glovsky and Popeo, P.C.; Kongsik Kim; Jhongwoo Jay Peck

(57) ABSTRACT

There provides a liquid crystal display apparatus and a backlight control method thereof. The liquid crystal display apparatus includes an image data acquisition part, a liquid crystal panel, a panel driving unit, a backlight module and a backlight driving unit; wherein the panel driving unit drives the liquid crystal panel and generates a backlight driving signal; the backlight driving unit includes a PWM module and a PFM module to modulate the backlight driving signal, thereby forming driving powers supplied to the backlight module; the liquid crystal display apparatus further includes a backlight modulation selection unit used to detect and calculate an average pixel brightness value A of the image data, and a reference pixel brightness value $A_0$ is further set therein; when $A \geq A_0$, the backlight modulation selection unit
(Continued)

selects to enable the PWM module; and when $A<A_0$, the backlight modulation selection unit selects to enable the PFM module.

14 Claims, 2 Drawing Sheets

(52) U.S. Cl.
CPC . *G09G 2320/0646* (2013.01); *G09G 2320/08* (2013.01); *G09G 2360/16* (2013.01)

(56) References Cited

U.S. PATENT DOCUMENTS

| | | | | |
|---|---|---|---|---|
| 2006/0033483 | A1 | 2/2006 | Wu | |
| 2009/0115757 | A1* | 5/2009 | Bae | G09G 3/3406 345/207 |

FOREIGN PATENT DOCUMENTS

| | | | |
|---|---|---|---|
| CN | 101430863 | | 5/2009 |
| CN | 102081908 | A | 6/2011 |
| CN | 10270804 | | 10/2012 |
| CN | 102737585 | A | 10/2012 |
| CN | 104050934 | A | 9/2014 |
| TW | 201105016 | A | 2/2011 |

* cited by examiner

LIQUID CRYSTAL DISPLAY APPARATUS AND BACKLIGHT CONTROL METHOD THEREOF

CROSS-REFERENCE TO RELATED APPLICATION

This application is the U.S. national phase of PCT Application No. PCT/CN2016/078255 filed on Apr. 1, 2016, which claims priority to CN Patent Application No. 201610146214.9 filed on Mar. 15, 2016, the disclosures of which are incorporated in their entirety by reference herein.

TECHNICAL FIELD

The present disclosure relates to display technical field, and more particularly to a liquid crystal display apparatus and a backlight control method thereof.

BACKGROUND ARTS

Nowadays, in the popular mobile phone and flat panel display apparatus, backlight part is the part having the largest power consumption, and the tendency of lightening and thinning the mobile phone and flat panel display apparatus extremely limits variability in size and capacity of the battery. For solving the problems of limitation to capacity of the battery as well as reduction of power consumption, Content Adaptive Brightness Control (CABC) technology is widely used. CABC technology is a backlight power-saving technology that is mainly used in Liquid crystal Display (LCD) screen.

In particular, CABC technology can adjust, according to an image displayed on the screen, a relation between gray level and screen backlight brightness of the image, and substantially maintain the display effect of the image while effectively reducing the screen backlight brightness. For example, the image is brightened by enhancing the gray level by 30%, and the image is darkened by reducing the backlight brightness of the LCD screen by 30%, thus the brightness presented by the image is substantially maintained the same before and after processing, and the power consumption of backlight is reduced by 30%. Backlight brightness can be controlled according to magnitude of driving voltage. An existing liquid crystal display apparatus using CABC technology is shown in FIG. 1. It mainly includes an image data acquisition part 1, a liquid crystal panel 2, a panel driving unit 3, a backlight module 4 and a Pulse-Width Modulation (PWM) backlight modulation unit 5. The image data acquisition part 1 is used to acquire image data $S_{RGB}$, the panel driving unit 3 drives the liquid crystal panel 2 according to the image data $S_{RGB}$ and generates a backlight driving signal $S_{PWM}$ corresponding to the image data $S_{RGB}$. The PWM backlight modulation unit 5 performs pulse width modulation to the backlight driving signal $S_{PWM}$, to form a driving power supply VL to supply to the backlight module 4.

In the liquid crystal display apparatus having the structure mentioned above, the dimming mode of the backlight is a single mode of performing pulse width modulation to the backlight driving signal $S_{PWM}$. PWM dimming has high conversion efficiency when the required backlight brightness is large; but the duty ratio of PWM dimming is very low when the required backlight brightness is small, which greatly reduces the efficiency of backlight driving, and goes against the effective use of the entire system energy of the liquid crystal display apparatus.

SUMMARY

To this end, the present invention provides a liquid crystal display apparatus and a backlight control method thereof. The liquid crystal display apparatus, using the CABC technology, improves overall efficiency of backlight driving by improving the backlight control structure and method.

To achieve the above purpose, the present invention uses the following technical solution:

A liquid crystal display apparatus, comprising an image data acquisition part, a liquid crystal panel, a panel driving unit, a backlight module and a backlight driving unit, wherein, the image data acquisition part is used to acquire image data; the panel driving unit drives the liquid crystal panel according to the image data and generates a backlight driving signal corresponding to the image data; the backlight driving unit comprises a Pulse-Width Modulation (PWM) module and a Pulse-Frequency Modulation (PFM) module, and one of the PWM module and the PFM module modulates the backlight driving signal during one display period to form a driving power supply to be supplied to the backlight module; and the liquid crystal display apparatus further comprises a backlight modulation selection unit which is used to detect and calculate an average pixel brightness value A of the image data, and a reference pixel brightness value $A_0$ is also set in the backlight modulation selection unit; when $A \geq A_0$, the backlight modulation selection unit selects to enable the PWM module; and when $A < A_0$, the backlight modulation selection unit selects to enable the PFM module.

Wherein the backlight modulation selection unit comprises an average pixel brightness detection module and a pixel brightness comparison module, wherein the average pixel brightness detection module is used to detect and calculate the average pixel brightness value A of the image data, the pixel brightness comparison module is used to store the reference pixel brightness value $A_0$ and compare the average pixel brightness value A with the reference pixel brightness value $A_0$.

Wherein the average pixel brightness detection module acquires the image data, and obtains the average pixel brightness value A through analysis and calculation on a gray histogram.

Wherein the reference pixel brightness value $A_0$ is 5%-25% of the maximum value of pixel brightness of the image data acquired by the image data acquisition part.

Wherein the panel driving unit receives image data from the image data acquisition part and increases gray level brightness of the image data according to a numerical ratio, so as to drive the liquid crystal panel; and the panel driving unit generates the backlight driving signal according to the condition that enables the backlight module to reduce the backlight brightness in accordance with the numerical ratio.

Wherein the numerical ratio is preset and is written in the panel driving unit by a register.

A backlight control method of the above mentioned liquid crystal display apparatus, the backlight control method comprises: receiving image data from the image data acquisition part by the panel driving unit, to generate a backlight driving signal corresponding to the image data; detecting and calculating the average pixel brightness value A of the image data by the backlight modulation selection unit, and comparing the average pixel brightness value A with the reference pixel brightness value $A_0$, when A≥A0, the backlight modulation selection unit selects to enable the PWM module, and the PWM module modulates the backlight driving signal to form a driving power supply to be supplied to the backlight module; and when $A<A_0$, the backlight modulation selection unit selects to enable the PFM module, and the PFM module modulates the backlight driving signal to form a driving power supply to be supplied to the backlight module.

Compared with the prior art, according to the liquid crystal display apparatus and the backlight control method provided in the embodiments of the present invention, the liquid crystal display apparatus using CABC technology, a backlight driving unit therein includes a Pulse-Width Modulation (PWM) module and a Pulse-Frequency Modulation (PFM) module, to determine the required backlight brightness level by detecting and calculating the average pixel brightness value of the image data; when large backlight brightness is required, PWM dimming may have a high conversion efficiency, and the PWM module modulates the backlight driving signal to form a driving power supply to supply to the backlight module; and when small backlight brightness is required, PFM dimming may have higher conversion efficiency, thus the PFM module modulates the backlight driving signal to form a driving power supply to supply to the backlight module. Base on this, the overall backlight driving efficiency is improved by improving the backlight control structure and method.

DETAILED DESCRIPTION OF EXEMPLARY EMBODIMENTS

Figure 1:
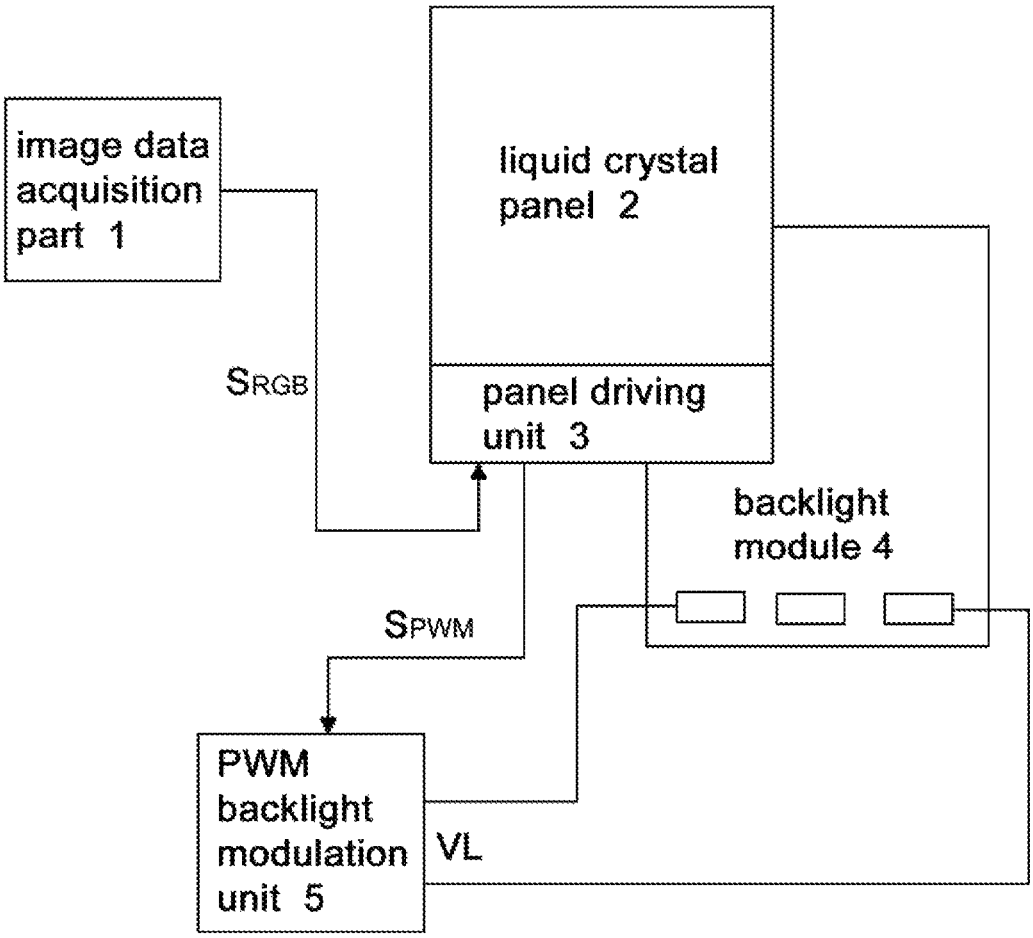
FIG. 1 is a structural block diagram of an existing liquid crystal display apparatus using CABC technology.

Hereinafter, the technical solutions in embodiments of the present invention will be described in details with reference to the attached drawings and details embodiments. Obviously, the described embodiments are only a part of embodiments in the present invention, not all embodiments. Based on the embodiments of the present application, all the other embodiments acquired by those ordinarily skilled in the art without exerting any creative efforts fall within a protection scope of the present application.

Here, it also should be explained that the figures merely show structures and/or processing steps which are closely associated with the scheme of the present invention, while other details which do not do much about the present invention are omitted in order to avoid unclearness of the present invention due to unnecessary details.

The present embodiment provides a liquid crystal display apparatus, which uses a new backlight control method. The method improves overall backlight driving efficiency by improving the backlight control structure and the backlight control method based on CABC technology. In particular, as shown in FIG. 2, the liquid crystal display apparatus includes an image data acquisition part 10, a liquid crystal panel 20, a panel driving unit 30, a backlight module 40 and a backlight driving unit 50 as well as a backlight modulation selection unit 60.

The image data acquisition part 10 serves to acquire each frame of the image data $S_{RGB}$ that needs to be displayed by the liquid crystal display apparatus, and to input each frame of the image data $S_{RGB}$ to the panel driving unit 30. The panel driving unit 30 drives the liquid crystal panel 20 according to each frame of the image data $S_{RGB}$ and further generates backlight driving signals $S_{PWM}$ corresponding to each frame of the image data $S_{RGB}$. The backlight driving unit 50 modulates the backlight driving signal $S_{PWM}$ to form driving power supply VL1 and VL2 to supply to the backlight module 40 such that the backlight module 40 generates a display light source having corresponding brightness to supply to the liquid crystal panel 20, and the liquid crystal panel 20 displays an image. The backlight modulation selection unit 60 serves to detect and calculate an average pixel brightness (namely, Average Picture gray Level (APL)) value of each frame of the image data $S_{RGB}$ from the image data acquisition part 10, and judges the brightness level of the backlight light source that needs to be provided by the backlight module 40 by comparing the detected and calculated APL value with a reference pixel brightness value preset in the backlight modulation selection unit 60 according to the detected and calculated APL value, to control the mode of the modulation (pulse width modulation mode or pulse frequency modulation mode) to the backlight driving signal $S_{PWM}$ performed by the backlight driving unit 50, thereby improving backlight driving efficiency.

Figure 2:
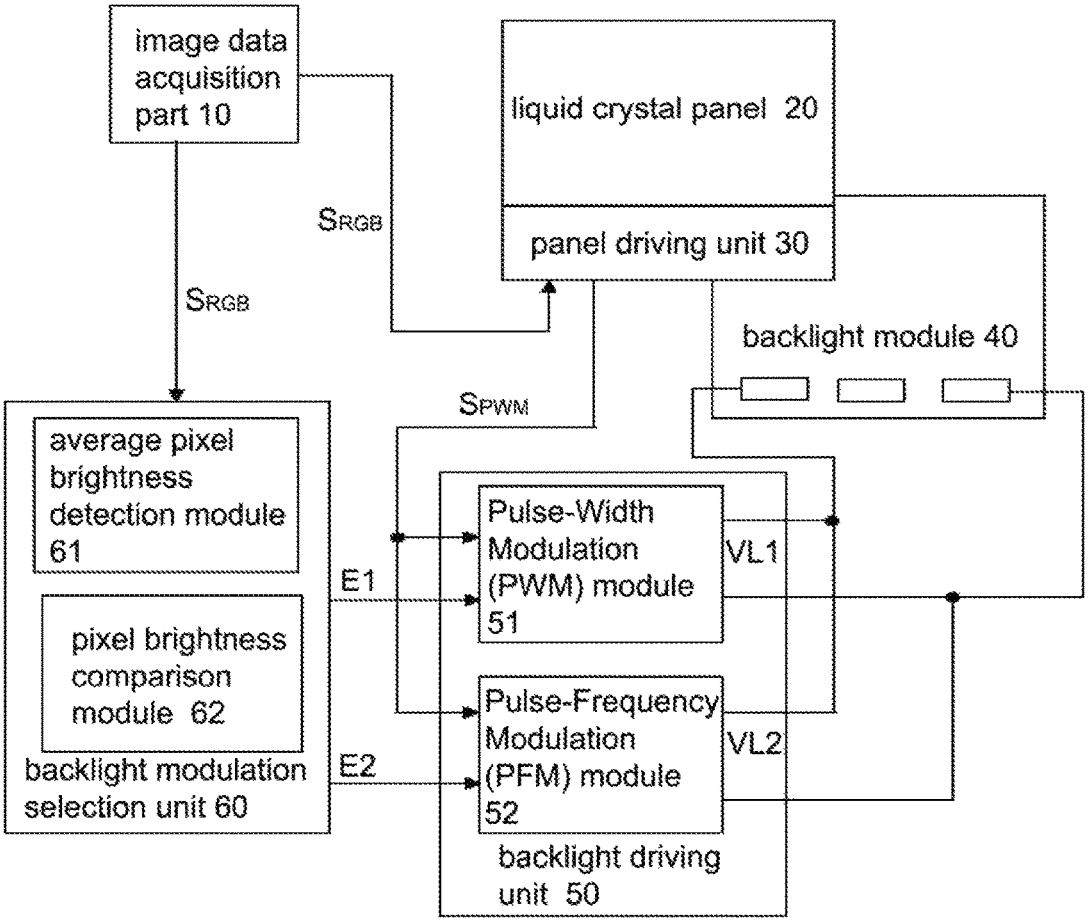
FIG. 2 is a structural block diagram of a liquid crystal display apparatus provided according to embodiments of the present invention.

Specifically, as shown in FIG. 2, the backlight driving unit 50 includes a Pulse-Width Modulation (PWM) module 51 and a Pulse-Frequency Modulation (PFM) module 52. During a display period of each frame, according to the selection control of the backlight modulation selection unit 60, the PWM module 51 performs pulse width modulation on the backlight driving signal $S_{PWM}$ to form a driving power supply VL1 to supply to the backlight module 40, or the PFM module 52 performs pulse frequency modulation to the backlight driving signal $S_{PWM}$ to form a driving power supply VL2 to supply to the backlight module 40. Here, A represents the average pixel brightness value of each frame of the image data $S_{RGB}$ detected and calculated by the backlight modulation selection unit 60, and A0 represents the preset reference pixel brightness value. When $A \geq A0$, the backlight modulation selection unit 60 outputs an enable signal E1 to the backlight driving signal 50 to enable/turn on the PWM module 51 to perform PWM on the backlight driving signal $S_{PWM}$; and when $A<A0$, the backlight modulation selection unit 60 outputs an enable signal E2 to the backlight driving unit 50 to enable/turn on the PFM module 52 to perform PFM on the backlight driving signal $S_{PWM}$.

In particular, as shown in FIG. 2, the backlight modulation selection unit 60 includes an average pixel brightness detection module 61 and a pixel brightness comparison module 62. The average pixel brightness detection module 61 is used to detect and calculate the average pixel brightness value A of each frame of the image data $S_{RGB}$ from the image data acquisition part 10, and the pixel brightness comparison module 62 is used to store the reference pixel brightness value $A_0$ and compares the average pixel brightness value A with the reference pixel brightness value A0. Where the average pixel brightness detection 61 acquires each frame of the image data $S_{RGB}$, and then calculates the average pixel brightness value A through analysis of a gray histogram. Where the reference pixel brightness value $A_0$ can be set in such a manner: if the maximum brightness value required for displaying each frame of an image is $A_1$, $A_0$ may be set to within 5%-25% of $A_1$.

Furthermore, the backlight control method of the above mentioned liquid crystal display apparatus mainly includes:

(1) using CABC technology: In an aspect, the panel driving unit 30 enhances the gray level brightness of the image data $S_{RGB}$ according a numeral ratio, to form corresponding driving signal to be input to the liquid crystal panel 20; In another aspect, the panel driving unit 30 generates the backlight driving signal $S_{PWM}$ based on the condition that enables the backlight module 40 to reduce the backlight brightness in accordance with the numeral ratio. Where the numeral ratio is a percentage value, it is preset (it can be set according to specific image to be displayed and client's demanded power-saving effect) and is written in the panel driving unit 30 by a register. CABC technology is a mature existing technology, thus the scope of the value is no longer specifically defined herein. In general, the value is selected as 30%, the image is brightened by enhancing the gray level of the image data $S_{RGB}$ by 30%, and the image is darkened by reducing the backlight brightness by 30%, thus the brightness presented by the image is maintained almost the same before and after processing, and the power consumption of its backlight is reduced by 30%.

(2) judging the brightness level of the backlight light source that needs to be provided, and selecting the corresponding dimming modes: the backlight modulation selection unit 60 detects each frame of the image data $S_{RGB}$ from the image data acquisition part 10, to calculate the average pixel brightness value A through analysis of a gray histogram, and compares the average pixel brightness value A with the reference pixel brightness value $A_0$. When $A \geq A_0$, the backlight modulation selection unit 60 selects to turn on the PWM module 51 to perform pulse width modulation on the backlight driving signal $S_{PWM}$, so as to form the driving power supply VL1 to supply to the backlight module 40; and when $A < A_0$, the backlight modulation selection unit 60 selects to turn on/enable the PFM module 52 to perform the pulse frequency modulation on the backlight driving signal $S_{PWM}$, so as to form the driving power supply VL2 to supply to the backlight module 40.

In conclusion, according to the liquid crystal display apparatus and the backlight control method thereof provided by embodiments of the present invention, the backlight power consumption is reduced by the liquid crystal display apparatus using CABC technology. The backlight driving unit therein includes a Pulse-Width Modulation (PWM) module and a Pulse-Frequency Modulation (PFM) module, to determine the required backlight brightness level by detecting and calculating the average pixel brightness value of the image data; that is: when large backlight brightness is required, a PWM dimming mode having higher efficiency on this occasion is used; and when small backlight brightness is required, a PFM dimming mode having higher efficiency on this occasion is used, thereby improving overall backlight driving efficiency.

It should be explained that the relationship terms, such as first and second, etc., in the present text are only used for distinguishing one entity or operation from another entity or operation without requiring or implying any actual relation or sequence existing between these entities or operations. Moreover, the term "include", "contain" or any other variant means covering instead of exclusively including, so that the process, method, object or device including a series of factors not only includes those factors but also includes other factors that are not explicitly listed or further include inherent factors for this process, method, object or device. Where no more limitations are provided, the factors defined by the sentence "include one . . . " do not exclude additional identical factors existing in the process, method, object or device which includes the factors.

Obviously, the protection scope of the present invention is not limited to the above detailed modes of carrying out the invention, and those skilled in the art may make various changes and modifications to the invention without departing from the scope and spirit of the invention. As such, if these changes and modifications of the present invention belong to the scope of the claims of the present invention and equivalent technologies thereof, the present invention also intends to include these changes and modifications here.

What is claimed:

1. A liquid crystal display apparatus comprising:

an image data acquisition part which is used to acquire image data;

a liquid crystal panel;

a panel driving unit which drives the liquid crystal panel according to the image data and generates a backlight driving signal corresponding to the image data;

a backlight module;

a backlight driving unit comprising a Pulse-Width Modulation (PWM) module and a Pulse-Frequency Modulation (PFM) module, wherein one of the PWM module and the PFM module modulates the backlight driving signal during one display period to form a driving power supply to be supplied to the backlight module; and a backlight modulation selection unit which is used to detect and calculate an average pixel brightness value A of the image data and compare the average pixel brightness value A with a reference pixel brightness value $A_0$, wherein when $A \geq A_0$, the backlight modulation selection unit selects to enable the PWM module and disable the PFM module; and when $A < A_0$, the backlight modulation selection unit selects to enable the PFM module and disable the PWM module.

2. The liquid crystal display apparatus of claim 1, wherein the backlight modulation selection unit comprises an average pixel brightness detection module and a pixel brightness comparison module, wherein the average pixel brightness detection module is used to detect and calculate the average pixel brightness value A of the image data, the pixel brightness comparison module is used to store the reference pixel brightness value $A_0$ and compare the average pixel brightness value A with the reference pixel brightness value $A_0$.

3. The liquid crystal display apparatus of claim 2, wherein the average pixel brightness detection module acquires the image data, and obtains the average pixel brightness value A through analysis and calculation on a gray histogram.

4. The liquid crystal display apparatus of claim 1, wherein the reference pixel brightness value $A_0$ is 5%-25% of the maximum value of pixel brightness of the image data acquired by the image data acquisition part.

5. The liquid crystal display apparatus of claim 2, wherein the reference pixel brightness value $A_0$ is 5%-25% of the maximum value of pixel brightness of the image data acquired by the image data acquisition part.

6. The liquid crystal display apparatus of claim 3, wherein the reference pixel brightness value $A_0$ is 5%-25% of the maximum value of pixel brightness of the image data acquired by the image data acquisition part.

7. The liquid crystal display apparatus of claim 1, wherein the panel driving unit receives image data from the image data acquisition part and increases gray level brightness of the image data according to a numerical ratio, so as to drive the liquid crystal panel; and the panel driving unit generates the backlight driving signal according to the condition that enables the backlight module to reduce the backlight brightness in accordance with the numerical ratio.

8. The liquid crystal display apparatus of claim 7, wherein the numerical ratio is preset and is written in the panel driving unit by a register.

9. A backlight control method of a liquid crystal display apparatus, wherein the liquid crystal display apparatus comprises an image data acquisition part, a liquid crystal panel, a panel driving unit, a backlight module, a backlight driving unit including a Pulse-Width Modulation (PWM) module and a Pulse-Frequency Modulation (PFM) module, and a backlight modulation selection unit, and the backlight control method comprises:

receiving image data from the image data acquisition part by the panel driving unit, to generate a backlight driving signal corresponding to the image data;

detecting and calculating an average pixel brightness value A of the image data by the backlight modulation selection unit; and comparing the average pixel brightness value A with a reference pixel brightness value $A_0$, when $A \geq A_0$, the backlight modulation selection unit selects to enable the PWM module and disable the PFM module, and the PWM module modulates the backlight driving signal to form a driving power supply to be supplied to the backlight module; and when $A < A_0$, the backlight modulation selection unit selects to enable the PFM module and disable the PWM module, and the PFM module modulates the backlight driving signal to form the driving power supply to be supplied to the backlight module.

10. The backlight control method of claim 9, wherein the backlight modulation selection unit acquires the image data, and obtains the average pixel brightness value A through analysis and calculation on a gray histogram.

11. The backlight control method of claim 9, wherein the reference pixel brightness value $A_0$ is 5%-25% of the maximum value of pixel brightness of the image data acquired by the image data acquisition part.

12. The backlight control method of claim 10, wherein the reference pixel brightness value $A_0$ is 5%-25% of the maximum value of pixel brightness of the image data acquired by the image data acquisition part.

13. The backlight control method of claim 9, wherein the panel driving unit receives image data from the image data acquisition part and increases gray level brightness of the image data according to a numerical ratio, so as to drive the liquid crystal panel; and the panel driving unit generates the backlight driving signal according to the condition that enables the backlight module to reduce the backlight brightness in accordance with the numerical ratio.

14. The backlight control method of claim 13, wherein the numerical ratio is preset and written in the panel driving unit by a register.

* * * * *